US007588522B2

(12) United States Patent
Heitzman

(10) Patent No.: US 7,588,522 B2
(45) Date of Patent: Sep. 15, 2009

(54) BALL AND FRAME EXERCISING APPARATUS

(76) Inventor: Charles J. Heitzman, 1330 Ala Moana Blvd., Ste 908, Honolulu, HI (US) 96813

( * ) Notice: Subject to any disclaimer, the term of this patent is extended or adjusted under 35 U.S.C. 154(b) by 0 days.

(21) Appl. No.: 12/069,550

(22) Filed: Feb. 11, 2008

(65) Prior Publication Data

US 2008/0176727 A1 Jul. 24, 2008

Related U.S. Application Data

(63) Continuation-in-part of application No. 11/130,999, filed on May 17, 2005, now Pat. No. 7,341,548.

(51) Int. Cl.
*A63B 26/00* (2006.01)

(52) U.S. Cl. ..... 482/142; 297/452.41; 297/195.11; 297/217.11; 446/220; 5/654

(58) Field of Classification Search ..... 482/140, 482/142, 91, 907; 446/220
See application file for complete search history.

(56) References Cited

U.S. PATENT DOCUMENTS

| | | | | |
|---|---|---|---|---|
| 3,635,528 | A | 1/1972 | Strom | |
| 3,899,210 | A | 8/1975 | Samhammer et al. | |
| 4,438,919 | A | 3/1984 | Gamzo | |
| 5,690,389 | A | 11/1997 | Ekman et al. | |
| 6,070,943 | A | 6/2000 | Guery-Strahm | |
| 6,375,601 | B1 * | 4/2002 | Johnson | 482/142 |
| 6,447,070 | B1 | 9/2002 | Ekman et al. | |
| 6,461,284 | B1 | 10/2002 | Francavilla | |
| 6,520,578 | B1 | 2/2003 | Jospa et al. | |
| D471,025 | S | 3/2003 | Chiu | |
| D471,371 | S | 3/2003 | Chiu | |
| 6,601,922 | B2 | 8/2003 | Doolan et al. | |
| 6,616,238 | B1 * | 9/2003 | Guery-Strahm | 297/452.41 |
| 6,702,388 | B1 | 3/2004 | Chiu | |
| 6,832,817 | B1 | 12/2004 | Chiu | |
| D503,553 | S | 4/2005 | Chiu | |
| D509,548 | S | 9/2005 | Heitzman et al. | |
| 7,044,558 | B2 | 5/2006 | Chiu | |
| 7,118,517 | B1 | 10/2006 | Hale | |
| 7,341,548 | B2 * | 3/2008 | Heitzman et al. | 482/142 |

* cited by examiner

*Primary Examiner*—Lori Amerson
(74) *Attorney, Agent, or Firm*—Jacox, Meckstroth & Jenkins

(57) ABSTRACT

A resilient exercising ball is confined within a frame which defines a space around the ball so that the ball has limited universal movement. The ball may be normally centered within the frame by elastic cords having end portions attached to the frame or by a bottom panel attached to the frame. The ball stretches the cords until the ball contacts a floor surface or a flexible bottom panel connected to the frame, and the ball rolls horizontally within the space in response to movement of the person's body. The frame may be in the form of rigid tubular sections forming arm rests or in a circular configuration with a flexible ball support pad connected to the frame by elastic cords. The frame may also have a V-shaped configuration or may have tubular sections connected by socket couplings or by interfitting end portions.

20 Claims, 3 Drawing Sheets

BALL AND FRAME EXERCISING APPARATUS

RELATED APPLICATION

This application is a continuation-in-part of application Ser. No. 11/130,999, filed May 17, 2005, U.S. Pat. No. 7,341,548.

BACKGROUND OF THE INVENTION

The benefits of exercising on a resilient ball as a fitness tool are well known. The ball is one of the most enjoyable, affordable and versatile exercise tools available. It has been used with low level neurological patients, rehabilitation, acute pain patients as well as with healthy school children and world class athletes. Exercising on the ball can be used by all ages from toddlers to seniors and adapted for use with groups of different abilities. The exercise concept is that movement on the ball changes the center of gravity of the user and causes the user's abdominal core muscles to tighten automatically to maintain balance.

SUMMARY OF THE INVENTION

The present invention is directed to exercising apparatus for improving the user's flexibility, balance, and body strength. As a centerpiece, a resilient ball is used to support the user's body weight in a sitting position. The ball is free standing and positioned in the center of a frame which captures and contains the ball, but with space provided so that the ball is free to move laterally or horizontally within the frame in response to the user's exercise motions. The ball has universal movement within the frame. The user's legs, waist, back, arms and head are all free to move for a full body workout. The user sits on the ball, like sitting in a chair. The frame may have arms to be used for stability, to maintain balance and for getting up and out of the exercising apparatus. Combining a chair-like frame or a surrounding frame with a ball makes it easier for the user to workout on the ball and maintain stability. The ball may be normally supported centrally with respect to the frame by a plurality of elastic members such as elastic rubber cords or straps or by a concaved surface. The combination of the ball and frame provides for a larger spectrum of users and age groups and for an expanded, safer way to exercise on the ball.

DESCRIPTION OF THE ILLUSTRATED EMBODIMENTS

Figure 1:
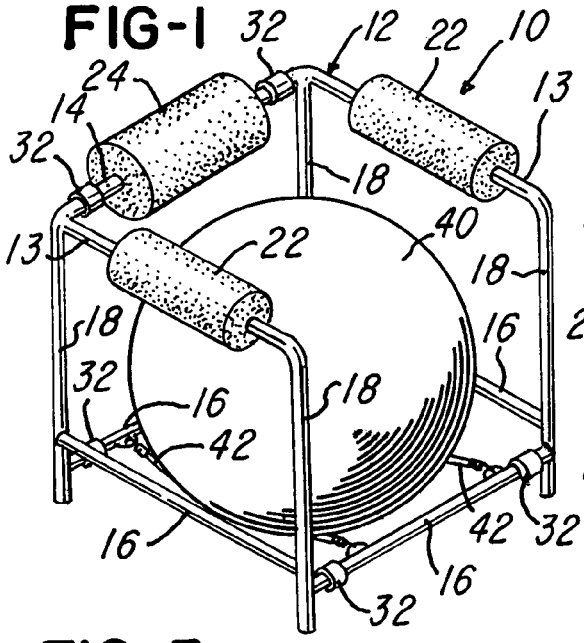
FIG. 1 is a perspective view of exercising apparatus constructed in accordance with the invention.

Referring to FIG. 1, an exercising apparatus 10 includes a chair-like frame 12 having rigidly connected frame members including side arm rails 13, a back rail 14, lower frame members 16 and vertical legs or frame members 18, all of which may be rigid tubes of plastic or metal. The arm rails 13 and back rail 14 support resilient foam cylindrical pads 22 and 24, respectively, to provide arm and back cushions. The frame 12 also includes socket couplings 32 releasably connecting the frame members to facilitate storage and shipping of the frame 12. An inflatable and resilient exercising ball 40 is confined within the frame 12 which forms an oversize enclosure for the ball 40. The ball is centered within the frame 12 by the centering means or members, for example, in the form of at least two elastic cords 42 connected to front and rear parallel frame members 16 by wire formed eyelets or hooks 43 and wire loops 44. The cords 42 and wire formed hooks 43 are of the conventional type such as a "Bungee Cord", but the hooks may be made so that an end portion of the wire extends into a hole within the frame members 16, thereby eliminating the need for the loops 44.

The user sits on the ball 40 which engages the floor F and supports the entire body weight of the user. By moving the body around, such as by lifting legs and holding arms out one at a time, the body movement on the ball changes the body center of gravity and causes the abdominal core muscles to tighten automatically to maintain balance. This form of exercise results in an increase in strength, flexibility and balance. The user may steady himself or herself by holding on to the upper side frame members or arm rails 13.

Figure 2:
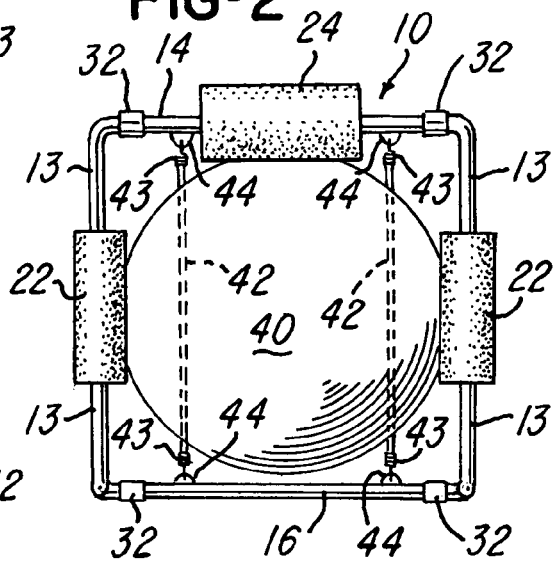
FIG. 2 is a top view of the apparatus shown in FIG. 1.
Figure 3:
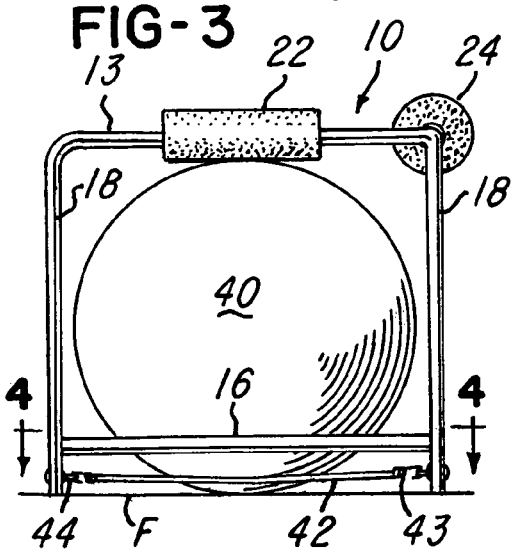
FIG. 3 is a side view of the apparatus shown in FIGS. 1 & 2.
Figure 4:
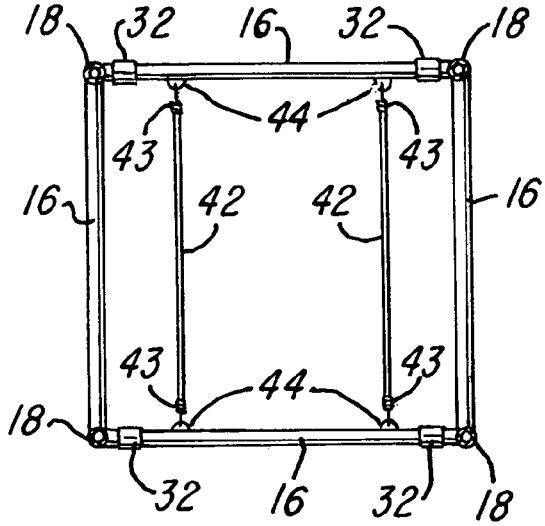
FIG. 4 is a section taken generally on the line 44 of FIG. 3, but without the ball shown in FIGS. 1-3.

FIGS. 2 and 3 show the top and side views of the apparatus 10 shown in FIG. 1. FIG. 2 illustrates that the ball 40 is surrounded by the frame 12 which is open in the front to allow the user to enter the apparatus and sit on the ball 40. FIG. 4 is a section showing the ball centering means in the form of two of the parallel spaced elastic rubber cords 42, which may be covered by tubular fabric. As mentioned above, the cords 42 have end portions attached by the hooks 43 to loops or rings 44 secured to the lower members 16 of the frame 12. The ball 40 is placed by the user in the chair frame 12, and the ball rests on the elastic cords 42. As the weight of the ball 40 depresses the elastic cords 42, the ball 40 moves to its lowest point, and the cords 42 center the ball 40 within the frame 12. After the user sits on the ball, the ball moves down and is supported by the floor F.

Figure 5:
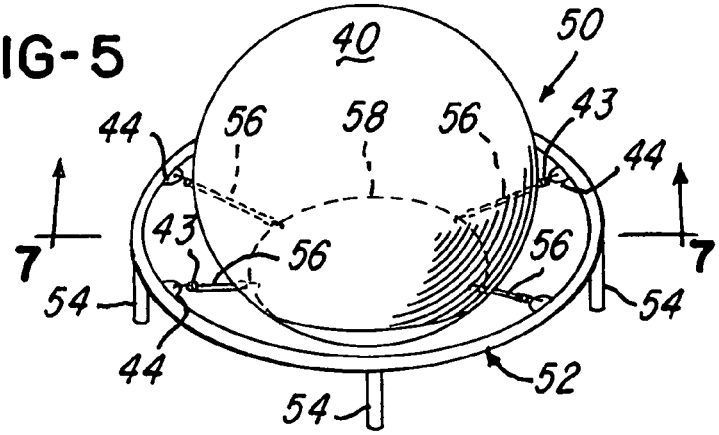
FIG. 5 shows a second embodiment of exercising apparatus constructed in accordance with the invention.
Figure 6:
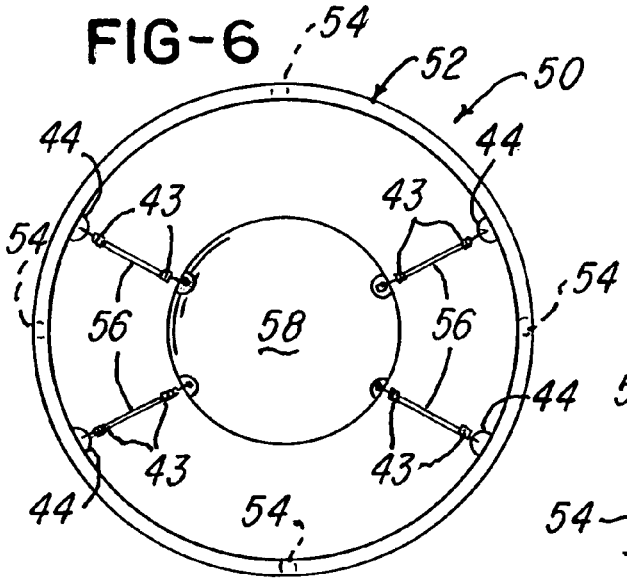
FIG. 6 is a top view of the apparatus shown in FIG. 5, but without a ball shown in FIG. 5.
Figure 7:
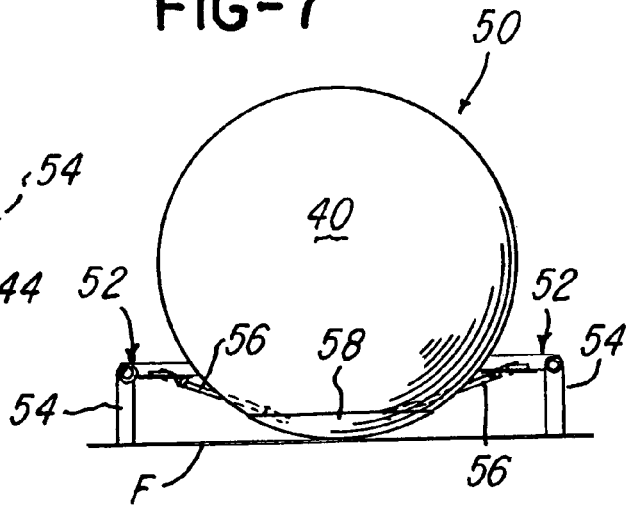
FIG. 7 is a section of the frame with the ball, taken generally on the line 7-7 of FIG. 5.

FIGS. 5-7 show another embodiment of exercise apparatus 50 constructed in accordance with the invention and which includes a circular tubular frame 52 supported by a set of four tubular legs 54 secured to the frame. The ball 40 is supported concentrically within the circular frame 52 by a set of four radially extending elastic straps or rubber cords 56 which have outer end portions connected to the frame 52 by the wire formed hooks 43 and loops 44 secured to the frame. The cords 56 have inner end portions connected by the wire formed hooks 43 to a circular center tray or pad 58 preferably formed of a flexible plastics sheet material or a woven fabric material. The elastic cords 56 and pad 58 cooperate to center the ball 40 normally within the surrounding circular frame 52. When a person or user sits on the ball 40, the elastic cords 56 stretch until the ball 40 and supporting center pad 58 contact the floor F, as shown in FIG. 7. The cords 56 and pad 58 provide for limited lateral rolling movement of the ball 40 within the annular space defined between the ball 40 and the frame 52.

Figure 8:
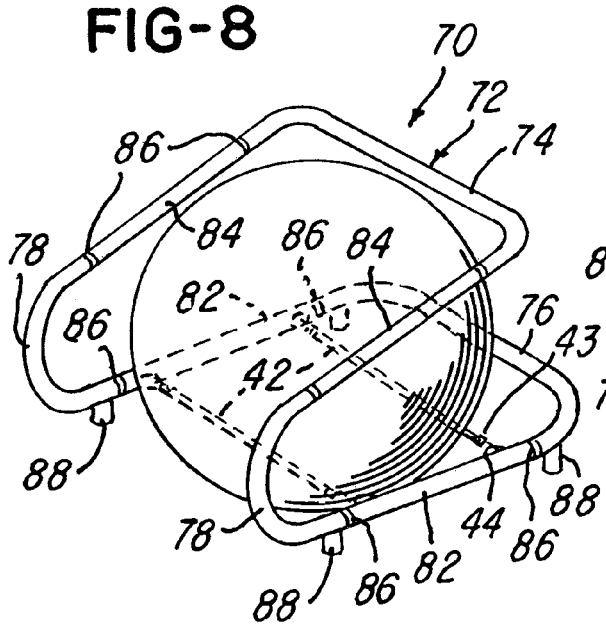
FIG. 8 shows a third embodiment of exercising apparatus constructed in accordance with the invention.
Figure 9:
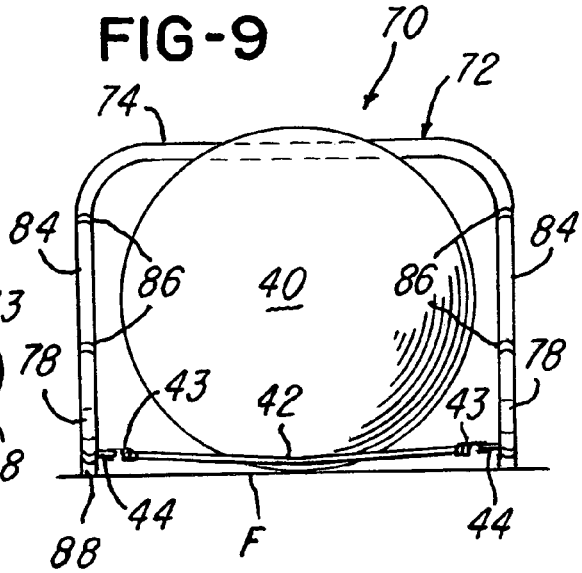
FIG. 9 is a front view of the exercising apparatus shown in FIG. 8.

Referring to FIGS. 8 and 9 which show another embodiment, an exercising apparatus 70 is constructed with a tubular metal or plastic frame 72 which also extends around the ball 40. The frame includes an upper U-shaped section 74 and a lower U-shaped section 76 which are rigidly connected by forward or front U-shaped sections 78, lower straight or linear sections 82 and upper straight or linear sections 84. The tubular sections are releasably connected together by sliding telescopic end portions or couplings which form joints 86. That is, some of the frame sections have a reduced end portion which telescopes into an opposing end portion of an adjacent section with a light press fit to form the rigid frame 72. The frame 72 has generally a wedge or V-shaped configuration with the bottom portion being horizontal and the upper portion being inclined. A set of resilient legs or pads 88 are secured to the end portions of the sections 76 and 78 to support the lower portion of the frame 72 spaced above the floor F, as shown in FIG. 9.

A pair of parallel spaced elastic or rubber straps or cords 42 have opposite end portions connected to the parallel linear sections 82 of the frame 72 by the wire formed hooks 43 and loops 44 secured to the frame sections 82. The cords 42 center the ball 40 laterally and also forwardly and rearwardly within the frame 72 on the floor F, as shown in FIG. 9. When a person or user sits on the ball 40, the cords 42 stretch until the bottom of the ball contacts or is supported by the floor. While the elastic cords 42 normally center the ball 40 within the frame 72, the cords 42 permit the ball to roll laterally, forwardly or rearwardly or horizontally in a universal manner in response to movement of the user's body.

Figure 10:
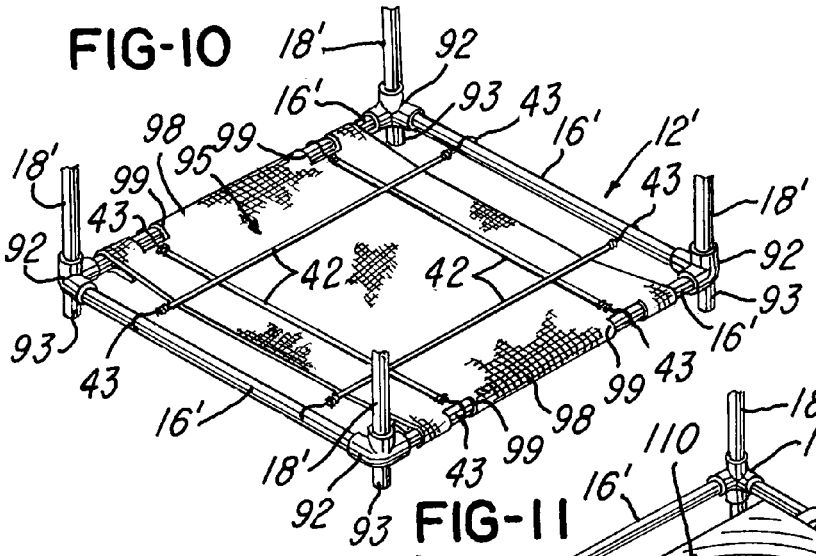
FIG. 10 is a perspective view of a lower portion of exercising apparatus without the ball and constructed in accordance with a modification of the invention.

Referring to FIG. 10, the lower portion of a modified frame 12' includes horizontal tubular rails or frame members 16' rigidly connected by three socket corner fittings or couplings 92 each of which also receives a vertical leg or frame member 18' and is supported by a foot member 93. The fittings or couplings 92 may be permanently connected to the horizontal frame member 16', for example, by cement or cross pins or rivets, and the vertical frame members 18' are removably connected to the couplings 92. Two pairs of crossing elastic cords 42 are connected to the frame 12' with each pair of cords 42 having its end hooks 43 attached to parallel spaced frame member 16'. End portions of the hooks 43 extend into corresponding holes formed within the frame members 16' to provide for conveniently attaching the end hooks without the wire loops 44, as mentioned above.

One pair or two pair of the elastic cords 42 cooperate to center the ball 40 within the frame 12', and a flexible fabric panel 95 extends under the cords 42 and has opposite hem portions 98 which receive parallel spaced horizontal frame members 16'. The fabric panel 95 has notches or cutouts 99 for receiving the hooks 43 and drapes under the cords 42 so that the mid portion of the panel touches the floor and is not supporting the weight of the user when the user is sitting on the ball 40. In the event the user becomes overactive and starts to tip the frame 12' over by pulling up on an arm rail or member 13, the frame 12' will pick up from the floor, and the fabric panel 95 resists further tipping. The fabric panel 95 has a plastic coating to provide for convenient cleaning and also protects the fitness ball 40 from any sharp object on the floor or supporting surface.

Figure 11:
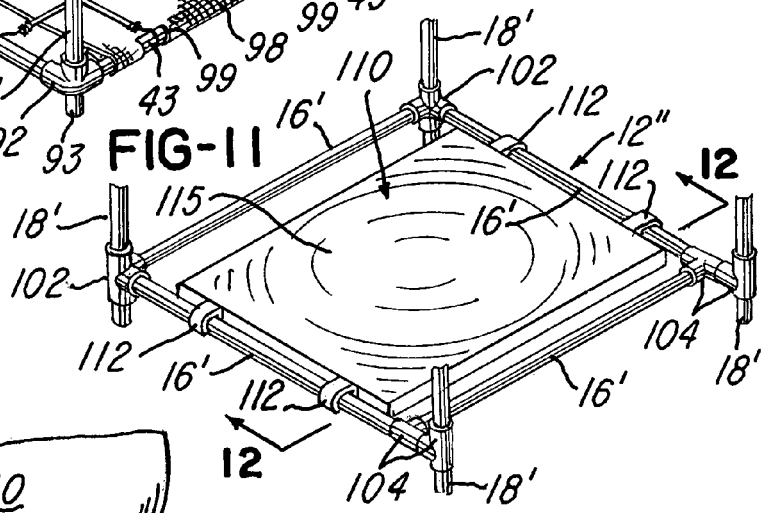
FIG. 11 is a view similar to FIG. 10 and showing another modification.
Figure 12:
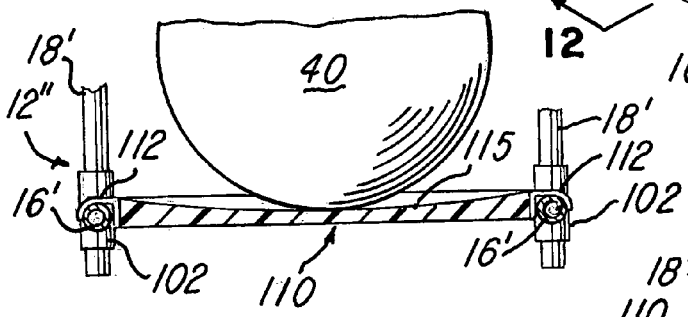
FIG. 12 is a section taken on the line 12-12 of FIG. 11 and showing a lower portion of the ball.
Figure 13:
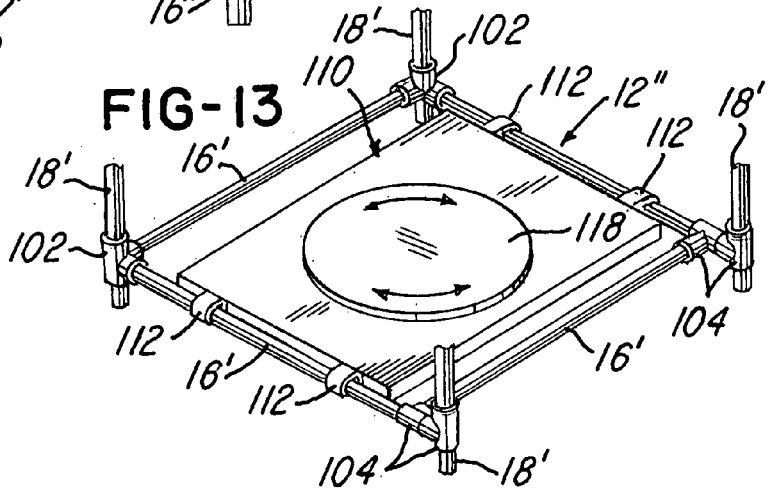
FIG. 13 is a view similar to FIG. 11 and showing a further modification of the apparatus.

Another modified frame 12" is shown in FIGS. 11-13 and wherein the horizontal frame members 16' are rigidly connected by four socket rear fittings or couplings 102 and three socket T-shaped front fittings or couplings 104, with all of the fittings or couplings 102 and 104 receiving the vertical legs or frame members 18'. The vertical legs or frame members 18' project downwardly through the couplings 102 and 104 to provide bottom end feet portions which elevate the horizontal frame member 16' from the floor surface. The front horizontal frame member 16' is also recessed rearwardly from the front vertical frame members 18' by another pair of fittings or couplings 104 to provide more space or freedom for the user's feet and to facilitate transfer of the user to and from a wheel chair.

As shown in FIGS. 11 & 12, the horizontal side frame rails or members 16' support a rigid platform or panel 110 which may be formed of a molded rigid plastics material. The panel 110 is removably attached to the side frame members 16' by inverted U-shaped brackets 112 rigidly secured to the panel 110. Preferably, the panel 110 has a part-spherical or slightly concaved top surface 115 which automatically self-centers the fitness ball 40 when the ball is not being used. It is also within the scope of the invention to provide the rigid platform or panel 110 (FIG. 13) with a freely rotatable turntable 118 which may be recessed within the panel 110 and/or may have a slightly concaved top surface. In each of the modifications shown in FIGS. 10-13, the flexible panel 95 or rigid panel 110 and the lower horizontal front and rear frame members 16' may be preassembled for shipping, and inverted U-shaped arm members having the vertical legs or frame members 18' may be assembled by the purchaser or user along with the horizontal back or rear frame member 14, shown in FIGS. 1 & 2. The vertical legs or frame members 18' are inserted into the fittings or couplings 92 or 102 and 104 and secured by spring-biased retractable pins or self-tapping screws threaded into aligned holes within the members.

While the forms of exercising apparatus herein described constitute preferred embodiments of the invention, it is to be understood that the invention is not limited to these precise forms of apparatus, and that changes may be made therein without departing from the scope and spirit of the invention as defined in the appended claims.

What is claimed is:

1. Exercising apparatus comprising: resilient ball adapted to support a person's body, a frame adapted to be firmly supported by a floor surface and receiving said ball, said frame including horizontally spaced and upwardly projecting frame members defining a horizontal space between a horizontal diameter of said ball and said frame members, a generally horizontal ball receiving member extending below said ball and connected to said frame, said frame and said horizontal space providing for universal horizontal rolling movement of said ball in all horizontal directions within said frame and on said ball receiving member without contacting said frame members when said ball is supporting the person's body and while said ball is supported within said frame, and said space also providing for vertical movement of said ball without contacting said frame members when said ball is supporting the person's body.

2. Exercising apparatus as defined in claim 1 wherein said ball receiving member comprises a flexible panel providing for said universal horizontal rolling movement of said ball.

3. Exercising apparatus as defined in claim 2 and including at least two spaced elastic cords adjacent said flexible panel and connected to said frame for normally positioning said ball in a generally center position within said frame when said apparatus is not in use.

4. Exercising apparatus as defined in claim 1 wherein said ball receiving member comprises at least two spaced elastic cords connected to said frame and normally positioning said ball in a generally center position within said frame when said apparatus is not in use.

5. Exercising apparatus as defined in claim 1 wherein said horizontally spaced frame members include a pair of generally parallel spaced arm members extending above generally parallel spaced lower frame members and rigidly connected to said lower frame members.

6. Exercising apparatus as defined in claim 5 wherein said frame includes a rigid back frame member positioned above said lower frame members and rigidly connecting said arm members.

7. Exercising apparatus as defined in claim 6 wherein said arm members and said back member each supports a resilient cushion.

8. Exercising apparatus a defined in claim 1 wherein said ball receiving member comprising of a substantially rigid horizontal panel.

9. Exercising apparatus as defined in claim 8 wherein said panel has a slightly concaved top surface normally supporting said ball in a generally center position within said frame when said apparatus is not in use.

10. Exercising apparatus as defined in claim 8 and including a rotary turntable mounted on said rigid panel and supporting said ball.

11. Exercising apparatus as defined in claim 1 wherein said frame members include a pair of vertical front frame members and a pair of vertical rear frame members rigidly connected by horizontal arm members.

12. Exercising apparatus as defined in claim 11 wherein said frame includes a lower horizontal front frame member spaced rearwardly from said vertical front frame members towards said vertical rear frame members.

13. Exercising apparatus comprising: resilient ball adapted to support a person's body, a frame adapted to be firmly supported by a floor surface and receiving said ball, said frame including horizontally spaced generally vertical frame members rigidly connected by horizontally spaced generally horizontal frame members, said frame members defining a horizontal space between a horizontal diameter of said ball and said frame members, a generally horizontal ball receiving member extending below said ball and connected to said frame members, said frame members and said horizontal space providing for universal horizontal rolling movement of said ball in all horizontal directions within said frame and on said ball receiving member without contacting said frame members when said ball is supporting the person's body and while said ball is supported within said frame, and said space also providing for vertical movement of said ball without contacting said frame members when said ball is supporting the person's body.

14. Exercising apparatus as defined in claim 13 wherein said ball receiving member comprises a flexible panel providing for said universal horizontal rolling movement of said ball.

15. Exercising apparatus as defined in claim 14 and including at least two spaced elastic cords adjacent said flexible panel and connected to said frame members for normally positioning said ball in a generally center position within said frame when said apparatus is not in use.

16. Exercising apparatus as defined in claim 13 wherein said ball receiving member comprises at least two spaced elastic cords connected to said frame members and normally positioning said ball in a generally center position within said frame when said apparatus is not in use.

17. Exercising apparatus as defined in claim 13 wherein said horizontal frame members include parallel spaced upper arm members extending above parallel spaced lower frame members.

18. Exercising apparatus as defined in claim 17 wherein said frame includes a rigid back frame member positioned above said lower frame members and rigidly connecting said arm members.

19. Exercising apparatus a defined in claim 13 wherein said ball receiving member comprising of a substantially rigid horizontal panel.

20. Exercising apparatus as defined in claim 19 wherein said panel has a slightly concaved top surface normally supporting said ball in a generally center position within said frame when said apparatus is not in use.

* * * * *